United States Patent [19]

Smith

[11] Patent Number: 4,749,128

[45] Date of Patent: Jun. 7, 1988

[54] SPRAY GUN

[76] Inventor: Gary L. Smith, 2869 Tabago, Costa Mesa, Calif. 92626

[21] Appl. No.: 936,364

[22] Filed: Dec. 1, 1986

[51] Int. Cl.[4] ..... B05B 7/08

[52] U.S. Cl. ..... 239/414; 239/417.3; 239/527; 137/625.18

[58] Field of Search ..... 239/416.4, 416.5, 417.3, 239/423–425, 416, 410, 411, 526, 527; 137/625.18; 222/135–137

[56] References Cited

U.S. PATENT DOCUMENTS

| | | | |
|---|---|---|---|
| 1,332,544 | 3/1920 | Davis | 239/411 |
| 2,059,706 | 11/1936 | Paasche | 239/526 X |
| 2,380,827 | 7/1945 | Downs | 239/526 X |
| 3,059,859 | 10/1962 | Hupp | 239/424 X |
| 3,066,874 | 12/1962 | Becker | 239/424 X |
| 3,344,992 | 10/1967 | Norris | 239/424.5 X |
| 3,589,607 | 6/1971 | Wolf | 239/424.5 X |
| 3,799,403 | 3/1974 | Probst et al. | 239/414 X |
| 3,873,023 | 3/1975 | Moss et al. | 239/414 X |

FOREIGN PATENT DOCUMENTS

| | | | |
|---|---|---|---|
| 593246 | 11/1932 | Fed. Rep. of Germany | 239/417.3 |
| 662158 | 5/1979 | U.S.S.R. | 239/411 |

*Primary Examiner*—Andres Kashnikow

*Assistant Examiner*—Kevin Patrick Weldon

*Attorney, Agent, or Firm*—Herb Boswell

[57] ABSTRACT

A spray gun has a housing with a piston chamber formed therein. A piston is movable within the piston chamber. One or more control rods connect to the piston and move in conjunction with the piston. The piston has a gas passageway in it. The gas passageway has a mouth which fits against a piston sealing member to control the flow of gas through the passageway. Each of the control rods includes a gas channel through the control rod extending from one end of the control rod to the other end of the control rod. Each of the control rods is associated with a spray component cavity with one of the ends of the respective control rods fitting in to a spray component seat within the component cavity. Movement of the control rod with respect to the seat serves as a valve for the spray component within the particular component cavity. In response to movement of the piston away from the piston sealing member, the control rods move away from their respective seat for discharging of the spray components from the component cavities. Concurrently, gas flow through the gas passageway in the piston is fed to the control rods for simultaneous ejection of gas through the spray component seats with the spray component.

21 Claims, 1 Drawing Sheet

SPRAY GUN

BACKGROUND OF THE INVENTION

This invention is directed to a spray gun for spraying a component system. The spray gun has a chamber with a piston located in the chamber and one or more hollow control rods attached to the piston. The hollow control rods each have an gas passage leading from one end of the control rod to the other. A first end of the control rod fits into a seat which serves as a valve for dispensing of a spray component. The piston includes an gas passage the end of which also sits into a seat. For better dispersion and ejection of the spray component from the spray gun, when the piston is retracted for spraying the spray component, the gas passage through the piston is open, allowing gas to flow through the piston and through the control rods so as to concurrently eject gas along with ejection of the spray component.

Numerous spray gun systems are known. These are utilized to dispense certain liquid components in a fine, even spray. For dispensing a single component, as for instance paint, a relatively unsophisticated, simple spray gun can be utilized since the paint stays liquid for a relatively long period of time.

In other, more sophisticated spray component systems, known as plural component systems, two or more components are concurrently sprayed from the gun. These components are mixed with one another and polymerize in a relatively short period of time, forming a polymerized solid. In these types of systems, consideration must be given to maintaining the separation of the components within the spray gun and for providing instantaneous cleaning for removing any mixed components from the spray gun to prevent these components from polymerizing within the spray gun. If the components do in fact polymerize within the spray gun itself, it is an arduous task to clean the spray gun. Cleaning of such a plugged spray gun requires disassembly of the spray gun and, in certain instances, replacement of certain blocked components, such as small nozzle orifices and the like.

One of the most useful plural component systems is a fiberglass system. In such a system a first component would be composed of a resin and a second component composed of a catalyst. These two components are sprayed from the spray gun and mixed in the spray directly in front of the spray gun. As soon as the components are mixed a reaction starts, polymerizing the resin into a solid, coherent mass.

These fiberglass spray guns can be augmented by including a chopper assembly which is capable of chopping up a fiberglass roving and concurrently spraying short segments of fiberglass into the spray pattern of the resin and catalyst ejected from the resin and catalyst nozzles. The composite mixture, the fiberglass strands embedded in the catalyzed resin, is directed to a surface for polymerization on the surface to form the fiberglass article.

In U.S. Pat. Nos. 3,947,962; 3,986,672 and 4,325,531, I, along with a co-inventor, described certain spray gun systems and/or chopper assemblies for spraying plural components, as for instance, a fiberglass system. Further, in U.S. Pat. No. 4,583,691 I described a clean-out system for these plural component spray guns.

Of the above spray gun systems, the system described in U.S. Pat. No. 3,986,672 would be normally used for spraying a resin and a catalyst to form a fiberglass. This would be utilized in conjunction with a chopper assembly, as for instance the chopper assembly shown in U.S. Pat. No. 3,947,962. For spraying other component systems, as for instance polyurethane systems or the like, the spray gun of the above mentioned U.S. Pat. No. 4,3425,513 would be most useful. Each of these patents describes spray guns which have very useful features incorporated therein.

The spray gun of U.S. Pat. No. 3,986,672 utilizes component mixing external of the nozzles of the gun with mixing of these components totally dependent upon the spray nozzles of this gun. The spray gun of U.S. Pat. No. 4,325,531 utilizes mixing within the body of the gun itself; however, the material ejected from this gun is not ejected in a spray pattern which would be useful for fiberglass systems, but in fact is ejected in a pattern useful for forming solid urethane foams or air entrained urethane foams. The spray pattern which is emitted from the spray gun of U.S. Pat. No. 4,325,513 is not useful for entraining chopped fiberglass strands therein for forming fiberglass.

In view of the above, it is evident that there exists a need for new and improved spray guns for spraying component systems and the like.

BRIEF DESCRIPTION OF THE INVENTION

This invention provides for new and improved spray guns which are capable of providing better mixing of two components in a spray pattern in front of the spray gun, as for instance, for spraying a fiberglass component system. Further, the spray guns of this invention are capable of being augmented with further systems, as for instance, standard roving chopper systems, for incorporation of fibers in a nozzle pattern exterior of the spray gun. Additionally, the spray guns of the invention utilizes certain engineering principles inherent therein which results in convenient and reproducible manufacturing of the spray guns and allows for consistent production of high quality spray guns which are susceptible to ease of use and a long working life.

These can be advantageously achieved in a spray gun which has a housing having a piston chamber formed in the housing. A control piston is located in the piston chamber so as to move within the piston chamber. At least one component control rod is attached to the piston where by it moves in response to the movement of the piston. The control rod is formed as an elongated control rod having a gas passage extending through the elongated dimension of the control rod between its ends. At least one component feed cavity is located in the housing. A means is located in association with the cavity for supplying a spray component to the feed cavity. A component discharge orifice is located in association with the feed cavity for discharging a component out of the feed cavity and out of the spray gun. A first end of the control rod is positioned in association with the component discharge orifice and is capable of moving with respect to the orifice to seal the orifice against discharge of the component from the orifice or to open the orifice allowing discharge of the component from the orifice. The piston chamber is provided with at least a first gas port and a pressurized gas supply means for supplying pressurized gas to the first gas port. An intrachamber gas control means is provided within the piston chamber between the gas port and the second end of the control rod. The intrachamber gas control means inhibits gas flow from the gas port to the second end of the gas control rod and through the gas control rod when the first end of the gas control rod seals against the orifice in the component feed cavity. The intrachamber gas control means further allows for gas flow from the gas port to the second end of the control rod and through the control rod for exiting out the first end of the control rod and through the orifice so as to concurrently discharge gas through the orifice in conjunction with the component being discharged from the orifice.

In an illustrative embodiment of the invention, the spray gun would be utilized for spraying a two component spray system and as such would utilize two control rods attaching to the piston. First and second component feed cavities would be provided in the spray gun with each of these having its own independent component feed means operatively associated with the feed cavity for supplying a component to the respective feed cavity. Each of the feed cavities would include a discharge orifice with the first end of the respective control rod located in association with the respective orifice.

In an illustrative embodiment of the invention the intrachamber gas control means would include a gas passageway formed in the piston, with this passageway having an inlet and a mouth. Further, the intrachamber gas control means would include a sealing member which is located in association with the piston so as to be capable of sealing the passageway mouth on the piston.

The above illustration embodiment can further include the piston dividing the chamber into a first region and a second region with the passageway inlet of the gas passageway through the piston located in the first region of the chamber and the passageway mouth of the gas passageway through the piston located in the second region of the chamber. Additionally, the second end of each of the control rods would be located in the second region of the chamber for receiving gas ejected into the second region of the chamber from the passageway mouth of the piston gas passageway.

In the above referred to illustrative embodiment of the invention the spray gun would be further provided with a trigger means for moving the piston in the chamber. the trigger means could include the chamber having a third region with the piston capable of sealing against the chamber in the third region. A second gas port would be located in the third region for supplying pressurized gas to the third region of the chamber, with this pressurized gas then moving the piston within the chamber.

BRIEF DESCRIPTION OF THE DRAWINGS

The invention described in this specification will be better understood when taken in conjunction with the drawings wherein.

Figures 1, 2:
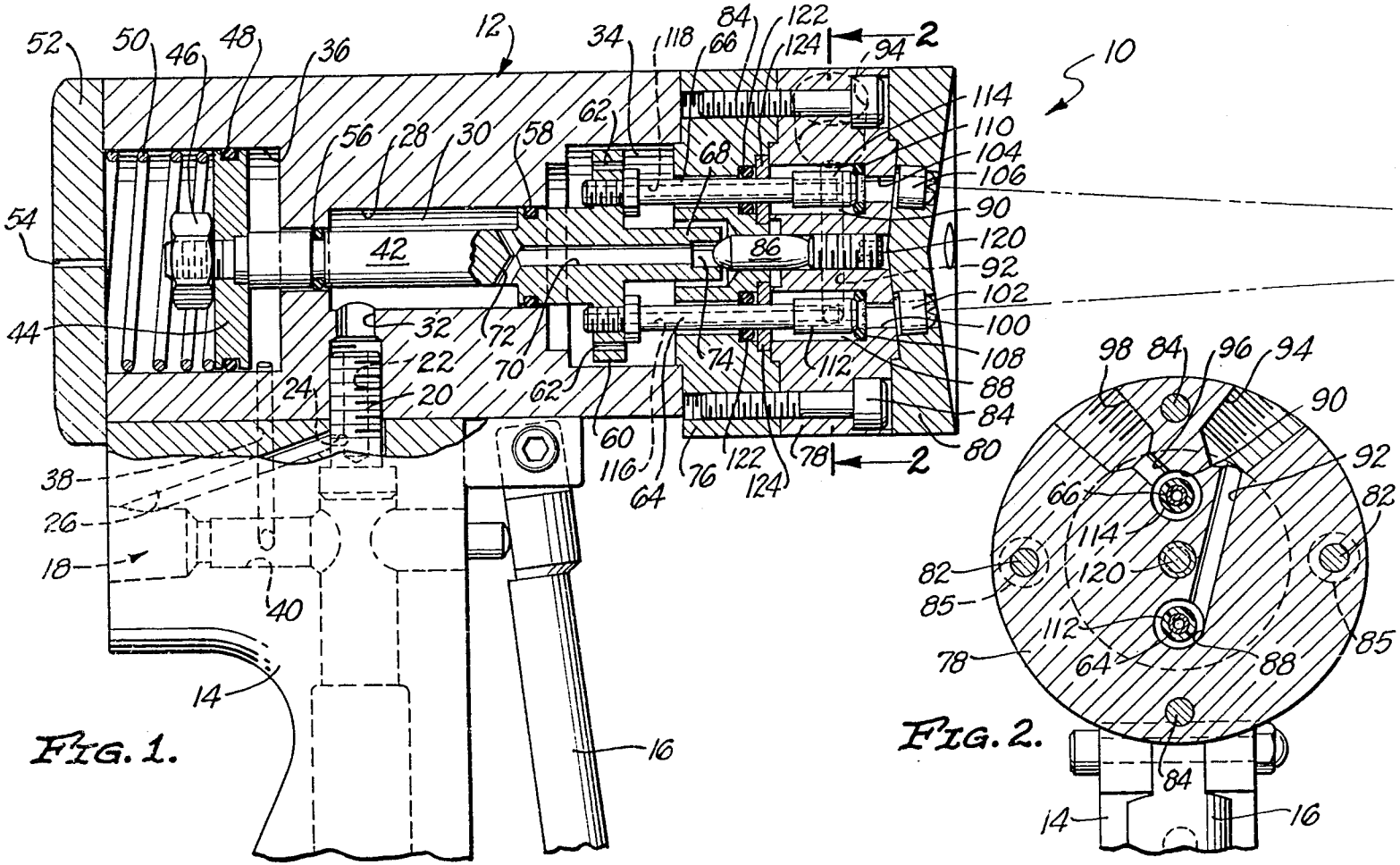
FIG. 1 is a side elevational view in partial section of a spray gun of this invention.
FIG. 2 is a front elevational view in section about the line 2—2 of FIG. 1.

The invention described in this specification and shown in the drawings utilizes certain principles and/or concepts as are set forth in the claims appended hereto. Those skilled in the spray gun arts will realize that these principles and/or concepts are capable of being illustrated in a variety of embodiments which may differ from the exact embodiments utilized for illustrative purposes herein. For this reason this invention is not to be construed as being limited solely to the illustrative embodiments but is only to be construed in view of the claims.

DETAILED DESCRIPTION OF THE INVENTION

A spray gun 10 of the invention has several component parts including a barrel 12 and a handle 14. Located in association with the handle 14 would be a trigger 16. During normal operation of the spray gun 10 the operator would hold the spray gun 10 via the handle 14 and operate the same by retracting the trigger 16 back toward the handle 14. Typically the spray gun 10 would be utilized for spraying a component system, as for instance a fiberglass component system, which has two components, i.e., a first resin component and a second catalyst component.

A supply of pressurized gas (not separately numbered or shown) would be provided to the spray gun 10 by attaching a pressurized gas line (not separately numbered or shown) to a gas inlet connector 18. Connecting between the barrel 12 on the handle 14 is a hollow bolt 20. The nut 20 has a passageway 22 which extends through the bolt 20 and includes a right angle section 24. The section 24 in the bolt 20 aligns with a drilling 26 formed in the handle 14 which leads to and makes a fluid connection with the gas inlet connector 18. As such, pressurized gas supplied to the gas inlet connector 18 is fed to the drilling 26 and into the interior of the nut 20.

The barrel 12 includes a chamber 28. The chamber 28 while formed as a continuous void can be considered as being divided into several regions which will be separately identified and numbered. The first of these is a first region 30, which is connected via a first gas inlet port 32 to the passageway 22 in the hollow bolt 20 such that pressurized gas from the gas inlet connector 18 is supplied to the first chamber region 30.

Aside from the first region 30, the chamber 28 further includes a second region 34, described in greater detail below, and a third region 36. A second gas inlet port 38 connects between the third region 36 of the chamber 28 and a supply drilling 40 in the handle 14. A gas control mechanism constructed as per the teachings of my U.S. Pat. No. 3,986,672 would be positioned in the supply drilling 40 and would connect to the trigger 16. For brevity of this specification this control mechanism is not separately shown or numbered, reference being made to my U.S. Pat. No. 3,986,672, the entire disclosure of which is herein incorporated by reference. Upon depression of the trigger 16 the control mechanism referred to in the previous sentence would control flow of pressurized gas through the second gas port 38 to the region 36 for pressurizing the third region 36 of the chamber 28.

A piston 42 is located within the chamber 28 for movement fore and aft within the chamber 28. The piston 42 includes a disk 44 mounted on one of its ends via a connecting nut 46. The disk 44 has an O ring 48 around its periphery which seals against the wall of the third region 36 of the chamber 28. A compression spring 50 is located between the disk 44 and a back wall 52 for urging the disk 44 and the piston 42 attached thereto forward that is to the right as viewed in FIG. 1. The back wall 52 includes a vent 54 located therein for equalizing pressure on the left hand side of the disk 44 with that of the ambient atmosphere. A further O ring 56 seals the piston 42 forward of the third region 36 of the chamber 28.

When trigger 16 is retracted back toward the handle 14 a control mechanism as is described in U.S. Pat. No. 3,986,672, feeds pressurized gas to the second gas inlet port 38 and through this port to the third region 36 of the chamber 28. This pressurizes this region moving the disk 44 back against the bias of the spring 50 to retract the piston 42 to the left, as seen in FIG. 1. When the trigger 16 is released and pressurized gas is no longer supplied to the second inlet port 38, the bias of the spring 50 pushes against the disk 44 pushing the piston 42 to the right as seen in FIG. 1. Movement to the left as seen in FIG. 1 is an activation or opening movement, and movement to the right is a deactivation or closing movement.

In addition to the second gas inlet port 38 which is controlled by the mechanism located within the supply drilling 40, a further gas port, not separately numbered or shown, could be utilized for control and drive of a chopper assembly, as for instance, the chopper assembly shown in my U.S. Pat. No. 3,947,962. Such a further gas inlet port is also shown in my U.S. Pat. No. 3,986,672. For brevity of this specification, a chopper assembly will not be separately shown or described, reference being made to my U.S. Pat. No. 3,947,962, the entire disclosure of which is herein incorporated by reference.

The piston 42 includes a further O ring 58 which together with the O ring 56 defines the first region 30 of the chamber 28. Just forward of the O ring 58, the chamber 28 flares out forming the second region 34. Within the second region 34 the piston includes a flange 60. The flange 60 can have a plurality of vents, such as vents 62, to allow for gas flow between the front of the flange 60 and the back of the flange 60. Attaching to the flange 60, by threading into the flange 60, are first and second control rods 64 and 66. In response to movement of the piston 42 in the chamber 28, since the control rods 64 and 66 are attached to the flange 60, the control rods 64 and 66 move in conjunction with movement of the piston 42.

The central portion of the piston 42 is formed as a hollow boss 68. This hollow boss includes a gas passageway 70. The gas passageway 70 has a gas inlet 72 positioned in the first region 30 of the chamber 28 and a mouth 74 positioned in the second region 34. Pressurized gas fed via the drilling 26 to the second gas port 32 is fed into the first region 30 of the chamber 28 defined by the O rings 56 and 58. These O rings seal the region 30 except for the gas port 32 and the gas inlet 72. The pressurized gas can then flow through the gas inlet 72 into the gas passageway 70 toward the mouth 74 of the gas passageway 70.

A first housing disk 76 is located on the front of the barrel 12. This housing disk 76 comprises a forward wall of the chamber 28. A second housing disk 78 is positioned in front of the first housing disk 76 and a nozzle disk 80 is positioned in front of the second housing disk 78. The nozzle disk 80 attaches to the second housing disk 78 via bolts 82 shown in section in Fig, 1. The second housing disk 78 is then attached to the first housing disk 76 via bolts 84 shown in FIG. 1. The first housing disk 76 is attached to the barrel 12 via bolts 85, only the head of which are seen in phantom line in FIG. 2, which lie in line with and directly beneath the bolts 82 utilized to attach the nozzle disk 80 to the second housing disk 78. As is evident from the above construction, the nozzle disk 80, the second housing disk 78 and the first housing disk 76 can be easily disassembled from the barrel 12.

A mouth or aperture sealing member 86 is positioned in a central drilling, not separately numbered, in both the second housing disk 78 and the first housing disk 76. This locates the mouth sealing member 86 directly in line with the boss 68 on the piston 42 and the gas passageway mouth 74 located on the end of the boss 68. When piston 42 is located forward within the chamber 28, the mouth sealing member 86 engages the mouth 74 of the gas passageway 70 to seal the gas passageway 70 such that pressurized gas fed via the drilling 26 to the first region 30 is not allowed to flow to the second region 34. However, when the piston 42 is retracted back toward the left as seen in FIG. 1, the boss portion 68 of the piston 42 moves backward to the left of the mouth sealing member 86, allowing for gas to flow from the mouth 74 back into the second region 34 of the chamber 28 to pressurize this region.

The second housing disk 78 includes a first component cavity 88 formed therein, and a second component cavity 90 formed therein. A drilling 92 seen in FIG. 2 leads to a component inlet connector 94 which attaches to a pressurized first component supply line (not separately numbered or shown) for supplying a first spray component to the first component cavity 88. Likewise, a drilling 96 leads to a second component inlet connector 98 for supplying a second component to the second component cavity 90.

The first component cavity 88 includes an orifice region 100 which leads to a first spray nozzle 102 located in the nozzle disk 80. In a similar manner, the second component cavity 90 includes an orifice region 104 leading to a second spray nozzle 106. A Teflon O ring 108 is located at the orifice 102 of the first component cavity 88 and a similar Teflon O ring 110 is located around the orifice 104 of the second component cavity 90.

Each of the control rods 64 and 66 have a first end, not separately numbered, which is positioned within the respective first and second component cavities 88 and 90, and a second end, not separately numbered, which attaches to the flange 60. A Teflon valve member 112 is threaded onto the first end of the control rod 64 within the first component cavity 88. A similar Teflon valve 114 is threaded onto the first end of the second control rod 66 within the second component 80. Each of the Teflon valve members 112 and 114 includes a central opening which is aligned with a drilling 116 which extends through the longitudinal axis of the control rod 64 and a similar drilling 118 extends through the central axis of the control rod 66. The drillings 116 and 118 extend completely through the control rods 64 and 66 respectively, such that there is a gas passageway through each of the control rods from their second ends to their first ends.

When the piston 42 is retracted to the left as seen in FIG. 1 away from the mouth sealing member 86, the mouth sealing member 86 no longer seals the mouth 74 of the gas passageway 70 in the piston 42 and gas can flow, as noted above, to the second region 34 of the chamber 28. Gas in this second region can then pass through the vents 62 in flange 60 and into the second end of the control rods 64 and 66. This pressurized gas then flows through the drillings 116 and 118 in the respective control rods 64 and 66 and is discharged from the openings in the Teflon valve member 112 and 114 directly into the orifices 100 and 104 of the first and second component cavities 88 and 90, respectively.

Concurrently, when the piston 42 is retracted toward the left as seen in FIG. 1, this retracts the Teflon valve members 112 and 114 back away from the Teflon O rings 108 and 110, respectively, such that the spray component located within the respective cavities 88 and 90 can flow through the respective orifices 100 and 104 and be ejected out of the respective nozzles 102 and 106. Concurrently with the ejection or spraying of the spray components out of the nozzles 102 and 106, pressurized gas is sprayed into these components via the gas passed through the control rods 64 and 66. This better disperses the components from the spray nozzles 102 and 106, as well as entrains gas into these components.

The better mixing and the gas entrainment within the spray components ensures that the spray components are thoroughly mixed. Because of this, different viscosities of these spray components can be used compared to prior spray guns, as for instance, a higher viscosity spray component. This was not possible with prior spray guns because of the inadequate mixing of these high viscosity components with one another. The gas entrainment within these higher viscosity spray components by the spray gun 10 breaks these higher viscosity spray components into fine droplets for even and thorough mixing of the same.

When the piston 42 is moved to the right under the bias of the spring 50 to close or shut down the spray gun 10, concurrently with the sealing of the mouth 74 on the piston 42, the Teflon valve members 112 and 114 seal against the Teflon O rings 108 and 110 to shut off the component supply system being ejected from the component cavities 88 and 90. This is much like the control system described in my U.S. Pat. No. 4,325,513. For this reason the entire disclosure of my U.S. Pat. No. 4,325,513 is herein incorporated by reference. However, contrary to the control system of my U.S. Pat. No. 4,325,513, the Teflon valve members 112 and 114 of the spray gun 10 of this invention have the openings leading to the drillings 116 and 118 in the respective control rods 64 and 66. When the valve members 112 and 114 seat against the O rings 108and 110 this shuts off the flow of the spray components from the respective cavities 88 and 90, but would not serve to shut off flow of pressurized gas through the drillings in the control rods 64 and 66. This, however, is controlled by sealing of the mouth 74 of the gas passageway 70 in the piston 42 against the mouth sealing member 86.

In order to coordinate concurrent sealing of the orifices 100 and 104 in the component cavities 88 and 90 with the sealing of the mouth 74 by the mouth sealing member 86, a set screw 120 is provided in the second housing disk 78. This serves to position the mouth sealing member 86 in the first and second housing disks 76 and 78 such that concurrently with sealing of the orifices 100 and 104 by the seating of the members 112 and 114 into the O rings 108 and 110, the mouth 74 on the piston 42 seats against the mouth sealing member 86. It is obvious that mouth sealing member 86 can be moved forward or backward compared to the mouth 74 on the piston 42 by appropriate adjustment of the set screw 120.

In order to seal the first and second component cavities 88 and 90 between the first and second housing disks 76 and 78 and to guide the control rods 64 and 66 through the first housing disk 76, O rings collectively identified by the numeral 122 fit around the respective control rods 64 and 66 as do guide bushings 124. Preferably the guide rings 122 would be Teflon O rings as per the O rings 108 and 110. During assembly, the control rods 64 and 66 are appropriately inserted through the O rings 122 and the guide bushings 124 followed by threading on of the Teflon valve members 112 and 114 onto the respective control rods 64 and 66.

It is evident that the spray gun 10 could be used for control of a single component, control of two components as described, or could even be utilized to control a further amount of components by providing additional control rods, component cavities and orifices in further multiples of those described herein. Thus, as per the spray gun 10, two control rods 64 and 66 are utilized and are spaced 180 degrees apart. If three control rods were utilized, these would be placed in a triangular array in a similar gun and would be spaced 120 degrees apart.

Since only a single control system, i.e. the piston passageway mouth 74 and the sealing member 86, is utilized for the gas ejection system feeding pressurized gas to the control rods, as for instance control rods 64 or 66, in providing additional spray components no consideration need be made to this portion of the spray gun 10 due to the symmetry of the spray gun 10.

For the spray gun 10 which has been illustrated or for any other spray gun having additional control rods, it is also realized that it might be desirable to only have gas spray from some of the control rods and not all of the control rods as is described above for the spray gun 10. This can be easily facilitated by simply providing a solid control rod instead of one having a drilling down its center if it is desired not to have that particular control rod as a gas dispensing control rod. As so provided, this control rod would not provide a gas passage to the appropriate orifice of the movement cavity with which this control rod interacted.

For most of their uses, the spray guns of the invention will use pressurized air as the pressurized gas, however, it is recognized that other pressurized gas might be used for particular plural component systems.

I claim:

1. A spray gun which comprises:

a housing;

said housing including a piston chamber located in said housing;

a control piston, said control piston movably located in said piston chamber;

at least one elongated component control rod attaching to said piston so as to move in response to movement of said piston, said elongated component control rod having ends and including a gas passageway extending through the elongated dimension of said rod between said ends, said gas passageway for conducting gas through said control rod;

a least one component feed cavity located in said housing;

at least one component feed means for supplying a spray component to said component feed cavity, said component feed means located on said housing in operative association with said component feed cavity;

a component discharge orifice in said component feed cavity for discharging said component out of said spray gun;

a first of the said ends of said control rod positioned in association with said component discharge orifice and capable of moving with respect to said orifice in response to movement of said piston to: (a) seal against said component discharge orifice, closing said orifice to inhibit discharge of said component through said orifice and (b) to move away from said component discharge orifice, opening said orifice for discharge of said component from said component feed cavity through said orifice;

said piston chamber having at least a first gas port;

pressurized gas supply means for supplying pressurized gas to said first gas port;

intrachamber gas control means for controlling the flow of pressurized gas within said piston chamber, said intrachamber gas control means positioned within said piston chamber in a gas pathway between said first gas port and the second of said ends of said control rod, said intrachamber gas control means: a) inhibiting gas flow from said first gas port to said second end of said control rod when said first end of said control rod seals against said orifice and b) allowing gas flow from said first gas port to said second end of said control rod and further through said control rod and through said orifice when said first end of said control rod moves away from said component discharge orifice;

said intrachamber gas control means includes a gas aperture means for discharging gas within said chamber; and said intrachamber gas control means further includes a aperture sealing means for sealing said gas aperture means against gas flow through said gas aperture means.

2. A spray gun which comprises:

a housing;

said housing including a piston chamber located in said housing;

a control piston, said control piston movably located in said piston chamber;

at least one elongated component control rod attaching to said piston so as to move in response to movement of said piston, said elongated component control rod having ends and including a gas passageway extending through the elongated dimension of said rod between said ends, said gas passageway for conducting gas through said control rod;

a least one component feed cavity located in said housing;

at least one component feed means for supplying a spray componet to said component feed cavity, said component feed means located on said housing in operative association with said component feed cavity;

a component discharge orifice in said component feed cavity for discharging said component out of said spray gun;

a first of the said ends of said control rod positioned in association with said component discharge orifice and capable of moving with respect to said orifice in response to movement of said piston to: (a) seal against said component discharge orifice, closing said orifice to inhibit discharge of said component through said orifice and (b) to move away from said component discharge orifice, opening said orifice for discharge of said component from said component feed cavity through said orifice;

said piston chamber having at least a firs gas port;

pressurized gas supply means for supplying pressurized gas to said first gas port;

intrachamber gas control means for controlling the flow of pressurized gas within said piston chamber, said intrachamber gas control means positioned within said piston chamber in a gas pathway between said first gas port and the second of said ends of said control rod, said intrachamber gas control means: (a) inhibiting gas flow from said first gas port to said second end of said control rod when said first end of said control rod seals against said orifice and (b) allowing gas flow from said first gas port to said second end of said control rod and further through said control rod and through said orifice when said first end of said control rod moves away from said component discharge orifice;

said intrachamber gas control means includes a gas aperture means for discharging gs within said chamber; and said intrachamber gas control means further includes a aperture sealing means for sealing said gas aperture means against gas flow through said gas aperture means;

said gas aperture means being located on said control piston; and said aperture sealing means being located within said chamber in operative association with said piston such that in response to movement of said piston in said chamber, said aperture sealing means seals against and released from said gas aperture means to control gas flow in said gas pathway within said chamber.

3. A spray gun which comprises:

a housing;

said housing including a piston chamber located in said housing;

a control piston, said control piston movably located in said piston chamber;

at least one elongated component control rod attaching to said piston so as to move in response to movement of said piston, said elongated component control rod having ends and including a gas passageway extending through the elongated dimension of said rod between said ends, said gas passageway for conducting gas through said control rod;

a least one component feed cavity located in said housing;

at least one component feed means for supplying a spray component to said component feed cavity, said component feed means located on said housing in operative association with said component feed cavity;

a component discharge orifice in said component feed cavity for discharging said component out of said spray gun;

a first of the said ends of said control rod positioned in association with said component discharge orifice and capableof moving with respect to said orifice in response to movement of said piston to: (a) seal against said component discharge orifice, closing said orifice to inhibit discharge of said component through said orifice and (b) to move away from said component discharge orifice, opening said orifice for discharge of said component from said component feed cavity through said orifice;

said piston chamber having at least a first gas port;

pressurized gas supply means for supplying pressurized gas to said first gas port;

intrachamber gas control means for controlling the flow of pressurized gas within said piston chamber, said intrachamber gas controlmeans positioned within said piston chamber in a gas pathway between said first gas port and the second of said ends of said control rod, said intrachamber gas control means: (a) inhibiting gas flow from said first gas port to said second end of said control rod when said first end of said control rod seals against said orifice and (b) allowing gas flow from said first gas port to said second end of said control rod and further through said control rod and through said orifice when said first end of said control rod moves away from said component discharge orifice;

said intrachamber gas control means includes said piston having a gas passageway, said gas passageway having a passageway inlet and a passageway mouth, said inlet opening into said chamber in operative association with said first gas port so as to be capable of receiving pressurized gas from said gas port;

said intrachamber gas control means further including a mouth sealing member located in said chamber in operative association with said passageway mouth on said piston, said mouth sealing member capable of sealing said passageway mouth against gas flow through said passageway mouth.

4. A spray gun of claim 3 wherein:

said piston capable of sealing against said chamber for dividing said chamber into a first region and a second region;

said first gas port and said passageway inlet both opening to said first region of said chamber; and said passageway mouth opening to said second region of said chamber.

5. A spray gun of claim 4 including:

said second end of said control rod being located in said second region of said chamber.

6. A spray gun which comprises:

a housing;

said housing including a piston chamber located in said housing, a control piston, said control piston movably located in said piston chamber;

at least one elongated component control rod attaching to said piston so as to move in response to movement of said psiton, said elongated component control rod having ends and including a gas passageway extending through the elongated dimension of said rod between said ends, said gas passageway for conducting gas through said control rod;

a least one component feed cavity located in said hosuing;

at least one component feed means for supplying a spray component to said component feed cavity, said component feed means located on said housing in operative association with said component feed cavity;

a component discharge orifice in said component feed cavity for discharging said component out of said spray gun;

a first of the said ends of said control rod positioned in association with said component discharge orifice and capable of moving with respect to said orifice in response to movement of said piston to: (a) seal against said component discharge orifice, closing said orifice to inhibit discharge of said component through said orifice and (b) to move away from said component discharge orifice, opening said orifice for discharge of said component from said component feed cavity through said orifice;

said piston chamber having at least a first gas port;

pressurized gas supply means for supplying pressurized gas to said first gas port;

intrachamber gas control means for controlling the flow of presurized gas within said piston chamber, said intrachamber gas controlmeans positioned within said piston chamber in a gas pathway between said first gas port and the second of said ends of said control rod, said intrachamber gas control means: (a) inhibiting gas flow from said first gas port to said second end of said control rod when said first end of said control rod seals against said orifice and (b) allowing flow from said first gas port to said second end of said control rod and further through said control rod and through said orifice when said first end of said control rod moves away from said component discharge orifice;

at least two of said control rods, each of said two control rods attaching to and moving with said piston;

a plurality of said component feed cavities equal in number to the number of said control rods, each of said component feed cavities including a component discharge orifice, each of said control rods operatively associated with one of said component discharge cavities with the first end of said respective control rod associated with the component discharge cavity of the respective component feed cavity; and a plurality of component feed means equal in number to the number of said component feed cavities, each of said component feed means operatively associated with one of said component feed cavities for supplying a spray component to said respective feed cavity.

7. A spray gun of claim 6 including:

said intrachamber gas control means includes said piston having a gas passageway, said gas passageway having a passageway inlet and a passageway mouth, said inlet openign into said chamber in operative association with said frist gas port so as to be capable of receiving pressurized gas from said gas port;

said intrachamber gas control means further including a mouth sealing member located in said chamber in operative association with said passageway mouth on said piston, said mouth sealing member capable of sealing said passagewaay mouth against gas flow through said passageway mouth.

8. A spray gun of claim 7 including:

chamber dividing means for dividing said chamber into at least a first region and a second region;

said first gas port and said passageway inlet both opening to said first region of said chamber; and said passageway mouth opening to said second region of said chamber.

9. A spray gun of claim 8 including:

said second end of each of said control rods bing located in said second region of said chamber.

10. A spray gun of claim 9 including:

a chamber wall positioned between said second region of said chamber and each of said component feed cavities;

said wall having a plurality of openings through said wall, the number of said openings equal to the number of said rods, each of said openings extending between said second region of said chamber and one of said component feed cavities; and one of said rods passing through each of said openings so as to position the second end of each of said rods in said second region of said chamber and the first end of each of said rods in one of said respective component feed cavities in operative association with the component discharge orifice associated with said respective cavity.

11. A spray gun of claim 10 including:

said mouth sealing member being located on said forward wall of said piston chamber; and said piston being movable towards and away from sai wall, said mouth sealing member sealing said passageway mouth in response to said piston moving towards said wall and said passageway mouth moving away from said mouth sealing member in response to said piston moving away from said wall to allow gas discharge from said passageway mouth into said second region of said chamber.

12. A spray gun of claim 5 wherein:

said chamber dividing means includes said piston having a first gasket means for sealing against said chamber for dividing said chamber into said first and second regions, said first gasket means located on said piston and movable with said pistion in response to movement of said piston in said chamber.

13. A spray gun of claim 1 further including:

trigger means for moving said piston in said chamber.

14. A spray gun of claim 4 including:

said chamber having a third chamber region;

said piston capable of sealing against said third region of said chamber;

said chamber having a second gas port, said second gas port located in association with said pressurized gas supplymeans for receiving pressurized gas from said pressurized gas supply means, said second gas port further located in association with said third region of said chamber for conducting pressurized gas to said third region of said chamber whereby pressurized gas in said third region of said chamber pushing against said piston moves said piston in said chamber.

15. A spray gun which comprises:

a housing;

said housing including a piston chamber located in said housing;

a control pistion, said control piston movably located in said piston chamber;

at least two elongated component control rods attaching to said piston so as to move in response to movement of said piston, said elongated component control rods each having ends and including a gas passageway extending through the elongated dimension of each of said rods between said ends of said rods, said gas passageways for conducting gas through said respective control rods;

a plurality of component feed cavities equal in number to the number of said control rods, each of said component feed cavities located in said housing;

a plurality of component feed means equal in number to the number of said component feed cavities for supplying spray components, each of said component feed means located on said housing in operative association with one of said component feed cavities for supplying a spray component to said respective feed cavitiy;

a component discharge orifice in each of said component feed cavities for discharging said component out of said spray gun;

each of said control rods operatively associated with one of said component feed cavities;

a first of said ends of each of said control rods positioned in association with the respective component discharge orifice of said respective component feed cavity with which the respective rod is associated and capable of moving with respect to said respective orifice in response to movement of said piston to: (a) seal against said respective component discharge orifice, closing said respective orifice to inhibit discharge of a respective spray component through said respective orifice and (b) to move away from said respective component discharge orifice, opening said respective orifice for discharge of a respective spary component from said respective component feed cavity through said respective orifice;

said piston chamber having at least a first gas port;

pressurized gas supply means for supplying pressurized gas to said first gas port;

said piston having a gas passageway, said passageway having a passageway inlet and a passageway mouth, said inlet opening into said chamber in operative association with said first gas port so as to be capable of receiving pressurized gas from said gas port; and further including a mouth sealing member located in said chamber in operative association with said passageway mouth on said piston, said mouth sealing member capable of sealing said passageway mouth against gas flow through said passageway mouth.

16. A spray gun of claim 15 wherein:

said chamber includes at least a first region and a second region;

said piston capable of sealing against said chamber for dividing said chamber into said first and second regions; said first gas port and said passageway inlet both opening to said first region of said chamber; and said passageway mouth opening to said second region of said chamber.

17. A spray gun of claim 16 wherein:

said second end of each of said control rods is located in said second region of said chamber.

18. A spray gun of claim 17 including:

a chamber forward wall positioned between said second region of said chamber and each of said component feed cavities;

said forward wall having a plurality of openings through said forward wall, the number of said openings equal to the number of said rods, each of said openings extending between said second region of said chamber and one of said component feed cavities; and one of said respective rods passing through each of said respective openings so as to position the second ends of each of said rods in said second region of said chamber and the first end of each of said respective rods in one of said respective component feed cavities in operative association with the respective component discharge orifice associated with said respective cavity.

19. A spray gun of claim 18 including:

said mouth sealing member is being located on said forward wall of said cavity; and said piston being movable towards and away from said forward wall, said mouth sealing member sealing said passageway mouth in response to said piston moving towards said forward wall and said passageway mouth moving away from said mouth sealing member in response to said piston moving away from said forward wall to allow gas discharge from said passageway mouth into said second region of said chamber.

20. A spray gun of claim 19 further including:

trigger means for moving said piston in said chamber.

21. A spray gun of claim 20 wherein:

said trigger means including said chamber having a third chamber;

said piston capable of sealing against said third region of said chamber;

said trigger means further including said chamber having a second gas port, said second gas port located in association with said pressurized gas supply means for receiving pressurized gas from said pressurized gas supply means, said second gas port further located in association with said third region of said chamber for conducting pressurized gas to said third region of said chamber whereby pressurized gas in said third region of said chamber pushing against said piston moves said piston in said chamber.

* * * * *

UNITED STATES PATENT AND TRADEMARK OFFICE

CERTIFICATE OF CORRECTION

PATENT NO. : 4,749,128

DATED : June 7, 1988

INVENTOR(S) : Gary L. Smith

It is certified that error appears in the above-identified patent and that said Letters Patent is hereby corrected as shown below:

Column 1, line 9, "an" should be --a--.

Column 1, line 12, "an" should be --a--.

Column 1, line 60, "4,325,531" should be --4,325,513--.

Column 2, line 6, "4,3425,513" should be --4,325,513--.

Column 2, line 13, "4,325,531" should be --4,325,513--.

Colum 2, line 47 "where by" should be --whereby--.

Column 4, line 23, "nut" should be --bolt--.

Column 4, line 29, "nut" should be --bolt--.

Column 5, line 60, "Fig, 1" should be --Fig. 2--.

Column 7, line 43, "108and" should be --108 and--.

Column 8, line 36, "movement" should be --component--.

Column 8, line 57, "a" should be --at--.

Column 9, line 51, "componet" should be --component--.

Column 9, line 68, "firs" should be --first--.

UNITED STATES PATENT AND TRADEMARK OFFICE

CERTIFICATE OF CORRECTION

PATENT NO. : 4,749,128

DATED : June 7, 1988

INVENTOR(S) : Gary L. Smith

It is certified that error appears in the above-identified patent and that said Letters Patent is hereby corrected as shown below:

Column 10, line 19, "gs" should be --gas--.

Column 10, line 31, "released" should be --releases--.

Column 10, line 48, "a" should be --at--.

Column 10, line 60, "capableof" should be --capable of--.

Column 11, line 5, "controlmeans" should be --control means--.

Column 11, 50, "psiton" should be --piston--.

Column 11, line 56, "a" should be --at--.

Column 11, line 57, "hosuing" should be --housing--.

Column 12, line 13, "controlmeans" should be --control means--.

Column 12, line 20, insert --gas-- between "allowing" and "flow".

Column 12, line 48, "openign" should be --opening--.

Column 12, line 49, "frist" should be --first--.

Column 12, line 56, "passagewaay" should be --passageway--.

Column 12, line 66, "bing" should be --being--.

UNITED STATES PATENT AND TRADEMARK OFFICE

CERTIFICATE OF CORRECTION

PATENT NO. : 4,749,128

DATED : June 7, 1988

INVENTOR(S) : Gary L. Smith

It is certified that error appears in the above-identified patent and that said Letters Patent is hereby corrected as shown below:

Column 13, line 19, "sai" should be --said--.

Column 13, line 28, "5" should be --8--.

Column 13, line 44, "supplymeans" should be --supply means--.

Column 14, line 7, "cavitiy" should be --cavity--.

Column 14, line 25, "spary" should be --spray--.

Signed and Sealed this

Twentieth Day of June, 1989

*Attest:*

*Attesting Officer*

DONALD J. QUIGG

*Commissioner of Patents and Trademarks*